US011473404B2

(12) United States Patent
Allen

(10) Patent No.: US 11,473,404 B2
(45) Date of Patent: Oct. 18, 2022

(54) CASING CLEANING TOOL

(71) Applicant: Anthony Allen, Lincolnshire (GB)

(72) Inventor: Anthony Allen, Lincolnshire (GB)

(73) Assignee: BigMini Ltd, Crowle (GB)

( * ) Notice: Subject to any disclaimer, the term of this patent is extended or adjusted under 35 U.S.C. 154(b) by 0 days.

(21) Appl. No.: 17/295,424

(22) PCT Filed: Mar. 25, 2020

(86) PCT No.: PCT/GB2020/050792

§ 371 (c)(1),
(2) Date: May 19, 2021

(87) PCT Pub. No.: WO2020/212686

PCT Pub. Date: Oct. 22, 2020

(65) Prior Publication Data

US 2022/0010653 A1 Jan. 13, 2022

(30) Foreign Application Priority Data

Apr. 17, 2019 (GB) ..... 1905457

(51) Int. Cl.

| | |
|---|---|
| ***E21B 37/02*** | (2006.01) |
| ***E21B 37/04*** | (2006.01) |
| ***B08B 9/043*** | (2006.01) |
| *E21B 17/00* | (2006.01) |

(52) U.S. Cl.

CPC ..... *E21B 37/02* (2013.01); *B08B 9/0436* (2013.01); *E21B 17/006* (2013.01); *E21B 37/04* (2013.01)

(58) Field of Classification Search

CPC ..... E21B 17/006; E21B 12/06; E21B 37/04; E21B 37/02

See application file for complete search history.

(56) References Cited

U.S. PATENT DOCUMENTS

| | | | | |
|---|---|---|---|---|
| 2,228,640 A | | 1/1941 | O'Neill | |
| 2,811,210 A | | 10/1957 | Guillot | |
| 2,845,129 A | | 7/1958 | Baker | |
| 3,007,525 A | * | 11/1961 | Orr | E21B 37/02 166/170 |
| 6,318,733 B1 | * | 11/2001 | Udagawa | F02F 11/002 277/593 |

(Continued)

FOREIGN PATENT DOCUMENTS

CN 104100231 A 10/2014

OTHER PUBLICATIONS

International Search Report, PCT/GB2020/050792, dated Jun. 26, 2020, 4 pages.

*Primary Examiner* — Robert E Fuller
*Assistant Examiner* — Lamia Quaim
(74) *Attorney, Agent, or Firm* — Penilla IP, APC

(57) ABSTRACT

A well cleaning tool (100) comprising: an elongate body (102) having a longitudinal axis; a central fluid bore (120) aligned with the longitudinal axis; and a cleaning element (110) mounted on the elongate body (102) and being displaceable with respect to the elongate body (102) in a direction inclined to the longitudinal axis, wherein the cleaning element (102) comprises at least one fluid channel (150) in fluid communication with the central fluid bore (120) and extending through the cleaning element (110) in a direction inclined to the longitudinal axis.

28 Claims, 3 Drawing Sheets

(56) References Cited

U.S. PATENT DOCUMENTS

| | | | | |
|---|---|---|---|---|
| 6,401,813 | B1 * | 6/2002 | Carmichael | E21B 34/02 166/173 |
| 2005/0205251 | A1 * | 9/2005 | Tulloch | E21B 37/02 166/173 |
| 2010/0071909 | A1 | 3/2010 | Winn | |
| 2011/0203063 | A1 * | 8/2011 | Atkins | E21B 37/02 15/104.05 |
| 2020/0332625 | A1 * | 10/2020 | Howitt | E21B 37/02 |

* cited by examiner

CASING CLEANING TOOL

CLAIM OF PRIORITY

This application is a national stage filing of and claims priority, under 35 U.S.C. § 371, to PCT/GB2020/050792, filed on Mar. 25, 2020, and titled "A CASING CLEANING TOOL", which is incorporated by reference herein in its entirety.

The present invention relates to well cleaning tools for removing debris accumulated in a well casing.

A wellbore may be drilled in the earth for various purposes, such as hydrocarbon extraction. After a wellbore is drilled, it is typically lined with a casing. The casing preserves the shape of the wellbore as well as providing a conduit for fluid to be transported to the surface.

In general, it is desirable to maintain a clean wellbore to prevent possible complications that may occur from the presence of debris. For example, accumulation of debris can prevent free movement of tools through the wellbore during operations, as well as possibly interfering with production of hydrocarbons or damaging tools. Potential debris includes cuttings produced from the drilling of the wellbore, metallic debris from the various tools and components used in operations and corrosion of the casing. Much of the debris can be removed by increasing the annular fluid velocity to bring larger particles to the surface of the wellbore.

However, over time, the casing within the wellbore becomes covered with hard deposits. These deposits must be periodically removed or they can build up to levels of thickness and hardness where they adversely affect efficient operation of the well.

Cleaning the inner wall of the casing and tubulars is desirable and often necessary in oil, gas or water well production. Typically, cleaning is accomplished by the use of speciality scrapers, brushes and a multitude of other types of cleaning tools. Such tools are typically lowered into the well to scrape and brush off debris from the inner wall of the casing as they progressively traverse the length of the well. The debris that is removed is then introduced back into the wellbore fluids and carried to the surface by circulation of the fluid where it is then filtered and disposed of.

Wellbore fluid often comprises drilling or completion fluids that contain specially blended chemicals and oils used within the industry. As the cleaning tools are lowered they initiate a pressure wave ahead of them as they move down the well. This pressure wave is known as a surge or "plunger effect" and can be detrimental to well production as the fluids are forced into formations which can ultimately render the well useless.

The standard tools used for cleaning casing walls are referred to as casing scrapers and are well known in the art. Typically, a casing scraper comprises a cylindrical body having a plurality of cleaning elements disposed at intervals around its outer surface, outwardly biased by way of compression coil springs and related retaining bolts, caps and screws, and a mandrel which facilitates connection to a drill string. The compression springs used to outwardly bias the cleaning elements are typically made of a high tensile material, such as high tensile steel, in order to withstand down-well operating forces. In use, the casing scraper is mechanically driven through the well casing on the drill string, causing the cleaning elements to scrape the inner surface of the well casing. The mechanical friction caused by the scraping action can lead to an unwanted increase in temperature in the vicinity of the wellbore which can result in temperature induced stresses and consequently wellbore stability problems. In addition, the increase in temperature can also lead to a degradation of the scraper blades, adversely affecting their cleaning action against the well casing.

A cleaning run can also add considerable time to well operation, representing significant cost. Therefore, casing scrapers are typically used in conjunction with other drill string tools, thereby avoiding the need for a separate cleaning run to be carried out on the well casing. The casing scraper may be mounted towards the end of the drill string or at a point along its length depending on the region of the well casing which it is required to be used on. Once the well has been serviced, the casing scraper can be drilled out using a rock bit, or the like.

In the known scrapers, the compression springs and related bolts, caps and screws present a significant problem, requiring additional time and effort to be successfully drilled out due to their high-tensile strength and can often lead to erosion of the rock bit. In addition, during subsequent cleaning, those elements may become lodged in a variety of down-well tools such as valves, circulating tools, packers and the like due to their small dimension, which can lead to equipment failure resulting in significant production downtime.

It is an object of the present invention to provide a cleaning tool that is entirely drillable with the option of being dissolvable or re-useable, depending on the material composition of the casing scraper.

In addition, it is an object of the present invention to provide a cleaning tool that is cost effective and of simple construction.

It is a further object of the present invention to provide a cleaning tool which can prevent the degradation of the cleaning elements performance due to the increase in temperature of the scraper blades caused by the scraping action against the well casing.

It is also an object of the present invention to provide a cleaning tool which can reduce the build-up of both positive and negative pressure within the wellbore fluid caused by lowering and raising of the drill string.

According to a first aspect of the present invention there is provided well cleaning tool comprising: an elongate body having a longitudinal axis; a central fluid bore aligned with the longitudinal axis; and a cleaning element mounted on the elongate body and being displaceable with respect to the elongate body in a direction inclined to the longitudinal axis, wherein the cleaning element comprises at least one fluid channel in fluid communication with the central fluid bore and extending through the cleaning element in a direction inclined to the longitudinal axis.

Advantageously, the flow of fluid through the cleaning element provides heat removal required to remove waste heat produced by the scraping action of the cleaning elements against the interior surface of the well casing. In addition, the flow of fluid assists in breaking up and dispersing debris from both the cleaning elements and the well casing, allowing the debris to be circulated upwards in the wellbore fluid for recovery at the surface. Further still, the flow of fluid through the cleaning tool has the effect of minimising the so called "plunger effect" which manifests itself as the tool is pushed through the body of well bore fluid and which resists movement of the tool through the fluid. These advantageous effects help to extend the life of the cleaning elements and increase the efficiency of their cleaning action against the well casing.

Preferably the well cleaning tool comprises a biasing means for biasing the cleaning element in a direction inclined to the longitudinal axis and is preferably located in a recess in the elongate body.

Preferably the biasing means comprises a resiliently deformable plate member mounted between the elongate body and the cleaning element.

It is further preferred that the resiliently deformable plate member abuts the cleaning element and the elongate body.

It is also preferred that the cleaning element comprises a concave inner face and that the resiliently deformable plate member is substantially flat prior to assembly.

Preferably, the resiliently deformable plate member deforms to correspond generally to the shape of the inner face of the cleaning element when assembled.

Preferably the biasing means comprises a spring.

In addition, it is preferred that the well cleaning tool comprises a plurality of cleaning elements.

Preferably the cleaning element is displaceable laterally. Further still, it is preferably that the cleaning element is displaceable radially with respect to the longitudinal axis.

In addition, it is preferable that the cleaning element is secured to the elongate body by a press-fit connection.

It is preferred that the cleaning element comprises a casing scraper.

In addition, it is preferred that the casing scraper comprises axially separated, helical grooves on its outer surface and axially separated, helical teeth on its outer surface.

It is also preferred that the cleaning tool comprises a plurality of cleaning elements and that the cleaning elements are identical and equiangularly displaced with respect to each other.

Preferably, the cleaning tool comprises a drillable material.

In addition, it is preferred that the resiliently deformable plate member comprises a drillable material.

Further still, it is preferred that the resiliently deformable plate member comprises an epoxy resin based material.

It is also preferred that the cleaning tool comprises connection means at one or both ends of the elongate body, for connection to a drill string, wherein the elongate body is secured against rotation on and against longitudinal movement along the drill string.

It is also preferred that the recess is in fluid communication with the central fluid bore, whereby fluid pressure within the central fluid bore is applied to the recess.

In addition, it is preferred that the fluid channel extends between an inlet aperture formed on the inner face of the cleaning element and an outlet aperture formed in the helical groove on the outer surface.

It is further preferred that the inlet aperture is in fluid communication with the recess, whereby fluid pressure within the recess is applied to the fluid channel.

It is also preferred that the cleaning element comprises a plurality of fluid channels each having an inlet aperture and an outlet aperture.

In addition, it is preferred that the outlet apertures are equiangularly spaced in the helical grooves.

Preferable, the resiliently deformable plate member comprises a plurality of apertures that align with the fluid inlet apertures formed on the inner face of the cleaning element when assembled.

In addition, it is preferred that the tool cleaning elements comprise steel bristles.

It is also preferred that the cleaning tool comprises a dissolvable material and that the dissolvable material is magnesium based.

A specific embodiment of the present invention will now be described, by way of example only, with reference to the accompanying drawings, in which.

Figure 1:
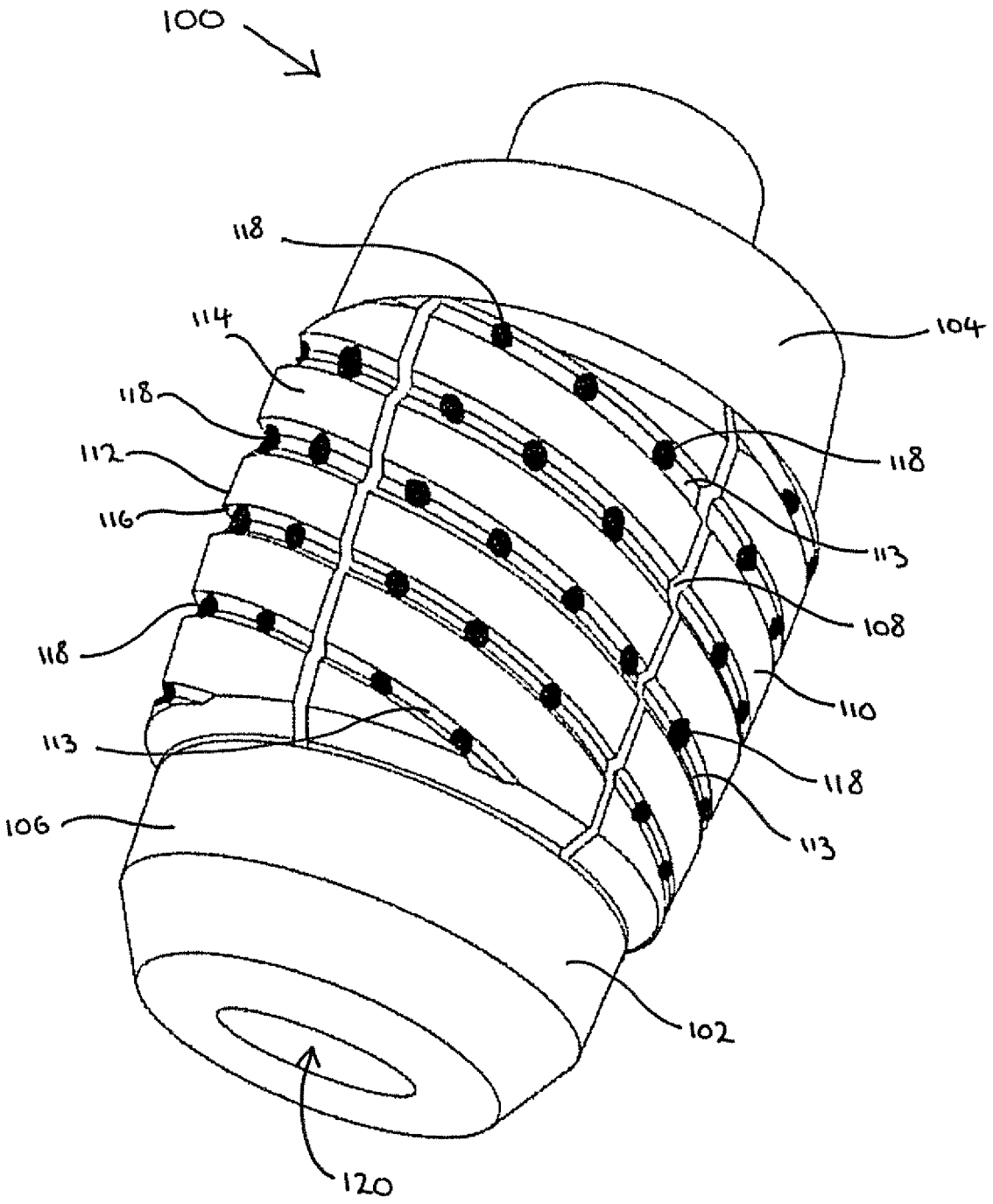
FIG. 1 is a perspective view of a cleaning tool, in accordance with the present invention.

Referring to FIG. 1 of the drawings, a casing scraper 100 has an elongate generally tubular body 102 having an upper end 104, a lower end 106, a tubular central portion 108 extending between the upper and lower ends and four identical scraper blocks 110 disposed on the outer surface thereof and displaceable in a radial direction.

The outer diameter of the casing scraper is defined by the position of the scraper blocks 110 with respect to the tubular body 102 and is such that the outer surface 112 of the scraper blocks 110 scrape the interior surface of a well casing (not shown). The body is formed from a drillable material such as, for example, aluminium alloy, cast iron or other composite material which can be drilled by a wellbore drilling bit, in particular, a rock bit. Although not shown in the drawing, the upper end 104 of the tubular body 102 is adapted for connection to the end of a drill string. To this end the upper end 104 of the tubular body 102 may be provided with a threaded mandrel.

The plurality of scraper blocks 110 are equiangularly spaced around the periphery of the tubular body 102, so that the scraping surfaces 112 of the scraper blocks collectively operate upon the entire circumference of the well casing. Axially separate, helical grooves 113 are formed in the outer surface 112 of each scraper block 110 and a series of equiangularly spaced fluid outlet apertures 118 are formed in the helical grooves. When the casing scraper 100 is assembled, the helical grooves of each scraper block align to form axially separated, helical teeth 114 between the grooves that are inclined towards the axis of the tool. The edges 116 of the teeth are chamfered to permit the blades to float more easily over or around unyielding obstacles within the wellbore to reduce scoring or damaging the casing.

Figure 2:
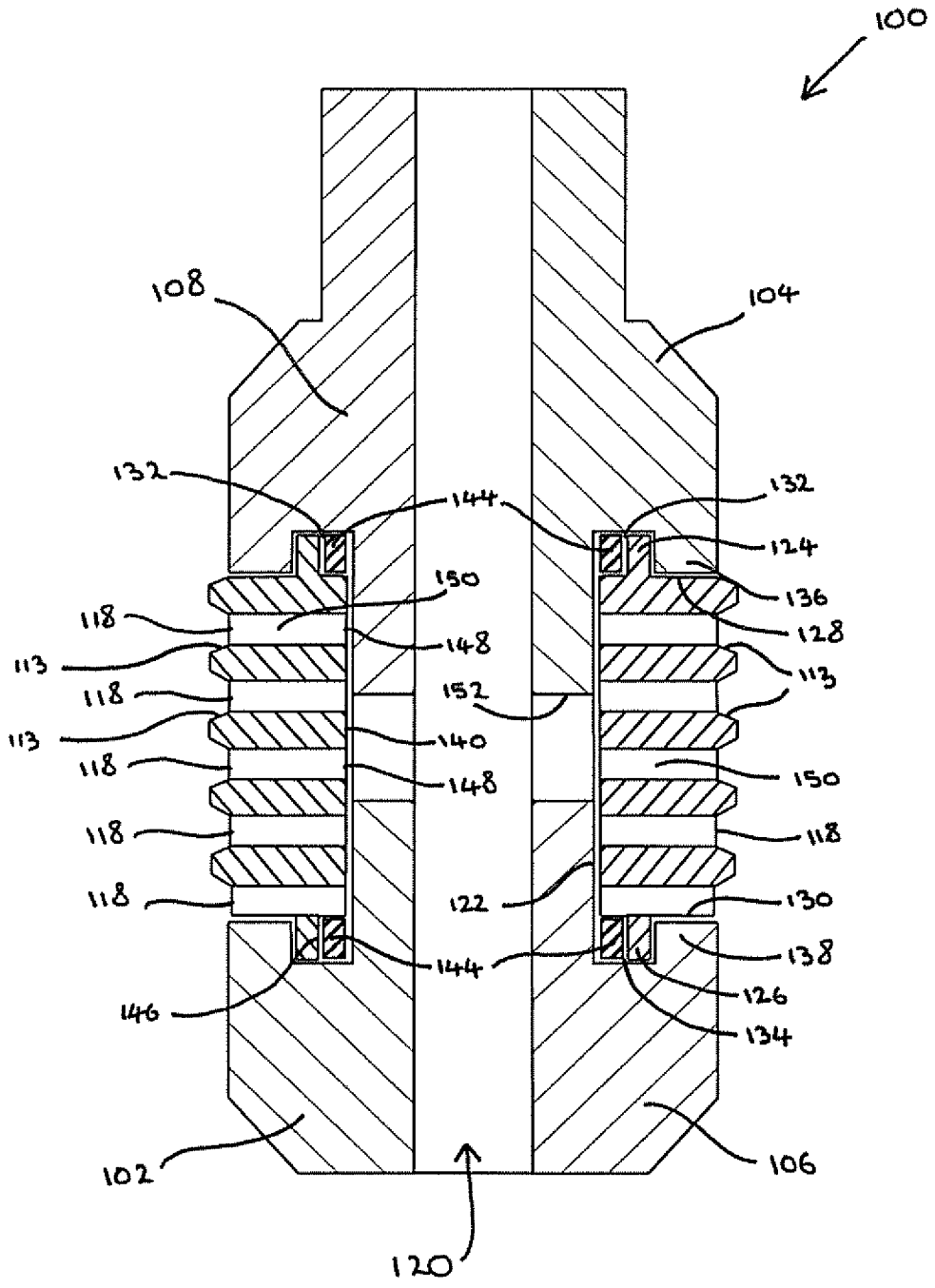
FIG. 2 is a vertical cross-section of the cleaning tool of FIG. 1, in accordance with the present invention.

As best seen in FIG. 2, a central fluid bore 120, which corresponds with the central fluid bore of an attached drill string (not shown), extends between the upper and lower ends 102, 104 and is aligned with the longitudinal axis of the tubular body 102 and allows drill string fluid to flow through the length of the body when the cleaning tool 100 is attached to a drill string. It will be understood that the cleaning tool 100 is locked on the drill string and cannot therefore rotate relative thereto, nor move longitudinally relative thereto. Therefore, in use, when the cleaning tool 100 is connected in a drill string and inserted into a wellbore, the cleaning tool 100 will rotate with the drill string and move through the wellbore with the drill string.

The outer face of the tubular central portion 108 is provided with a recessed waisted portion 122 which extends around the entire outer circumference of the tool body 102. The scraper blocks 110 are mounted in this recess 122, and are equiangularly spaced with respect to the tool body 102. Each scraper block 110 is provided with upper and lower retaining projections 124, 126 along the upper 128 and lower edges 130, which are seated in respective peripherally extending recesses 132, 134 formed by overhanging portions 136, 138 formed in the tubular body at the upper and lower ends of the recessed waisted portion 122.

The projections 124, 126 on the scraper blocks 110 engage an inner face of the shoulder portions 136, 138 on the upper 104 and lower 106 ends, so that the maximum outward displacement of the scraper blocks 110 is limited. The inner face of each scraper block 110 is formed into an elongate centrally disposed intermediate lug 140 extending parallel to the longitudinal axis of the scraper block and projecting radially inwardly. The lug 140 is seated in a complementarily shaped recess 142 formed in the recessed waisted portion 122 of the tool, the lug 140 being a press or interference fit within the recess 142. The side walls of the lug 140 and the corresponding walls of the recess 134 extend radially with respect to the longitudinal axis of the tubular body, whereby the scraper blocks 110 are constrained to be displaceable in the radial direction.

Each scraper block 110 is biased radially outwardly with respect to the tubular body 102 by a respective resiliently deformable spring plate 144. Each spring plate 144 abuts the inner face 146 of its associated scraper block 110 and the recessed waisted portion 122 of the tool body 102 so that the scraper blocks 110 are biased radially outwardly relative to the longitudinal axis of the tool 100. The maximum radial projection of the scraper blocks 110 is determined by the inter-engagement of the shoulders 136, 138 and the projections 124, 126. However, if a tool 100 is run in a casing having a diameter less than this maximum, this reduced diameter can be accommodated by deformation of the spring plates 144 (described in more detail below with reference to FIG. 3).

As seen in FIG. 2, a series of fluid inlet apertures 148, located radially opposite the series of fluid outlet apertures 118, are formed on the inner face 146 and lug 140 of the scraper block, with a fluid channel 150 extending perpendicularly to the longitudinal axis of the tool 100 between each fluid inlet aperture 148 and its corresponding fluid outlet aperture 118.

The central fluid bore 120 communicates with each recess 142 through an aperture 152 that extends perpendicularly to the longitudinal axis of the tool 100. As a consequence, fluid pressure within the central fluid bore 120 is also applied to the inner face 146 of the scraper block 110, thereby increasing pressure within the fluid channels 150.

In the illustrated example, the fluid channels 150 provide an internal pathway for fluid to pass through the cleaning tool, allowing fluid to pass through the body of the tool 100 and subsequently through the scraper blocks 110, past the blades and onto the interior surface of the well casing. The flow of fluid through the scraper blocks 110 provides heat removal required to remove waste heat produced by the scraping action of the scraper blocks 110 against the interior surface of the well casing. This extends the life of the scraper blocks 110 and increases the efficiency of the blades. In addition, the application of fluid assists in breaking up and dispersing debris from the blades of the scraper block, upwards into the circulating well fluids for recovery at the surface. The internal pathway also has the effect of minimising the so called "plunger effect" which manifests itself as the tool 100 is pushed through a body of fluid and which resists movement of the tool 100 through the fluid.

In use, as the tool 100 is moved down the wellbore, fluid travels through the central fluid bore 120, through the aperture 152, into the recess 142 and in to the fluid channels 150. The resultant increase in pressure within the fluid channels 150 results in the application of a fluid jet, radially outwardly, which assists in the removal of debris from the blades of the scraper block increasing their cleaning action on the inner wall of the casing. The fluid jet also directly removes debris from the inner wall of the casing. Conversely, as the tool 100 is retracted from the wellbore, the pressure within the fluid channels 150 decreases and the application of the fluid jet stops.

Figure 3:
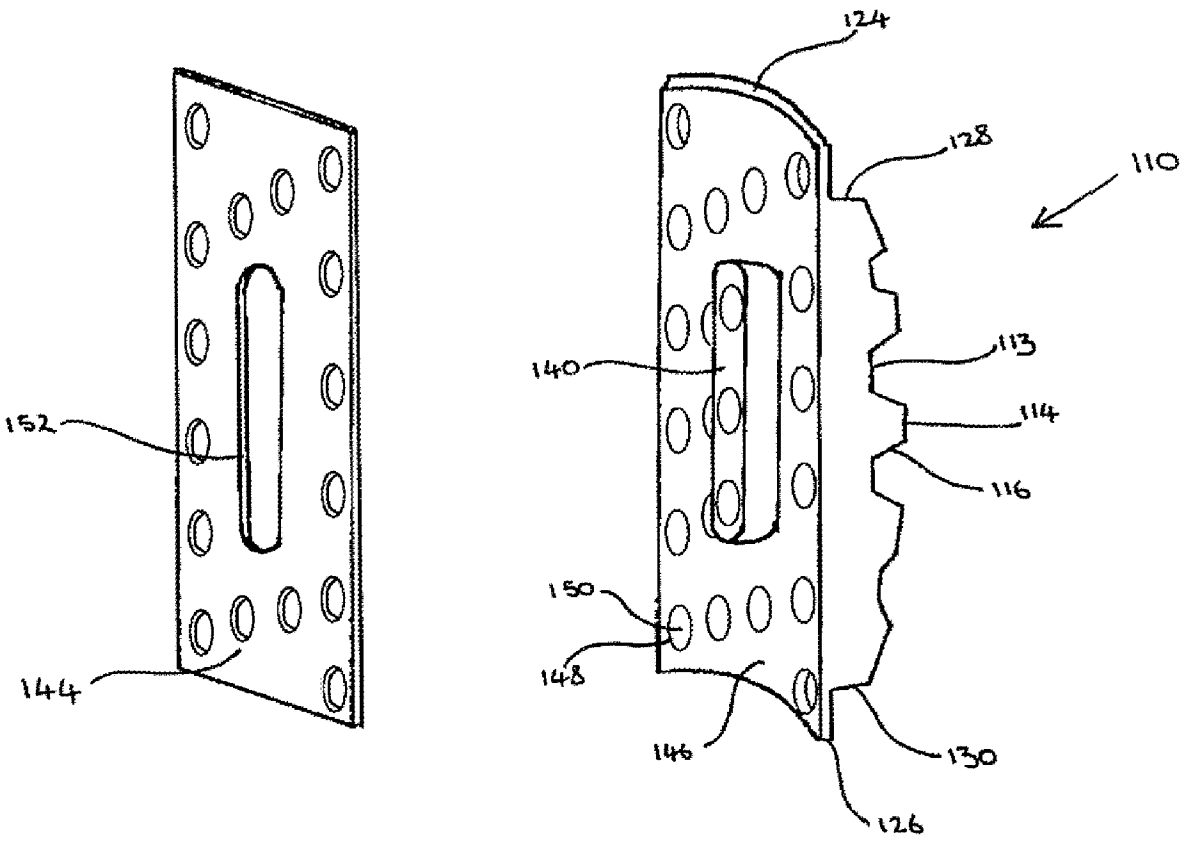
FIG. 3 is an exploded view of a cleaning element and resiliently deformable member which forms part of the cleaning tool of FIG. 1, in accordance with the present invention.

As illustrated in FIG. 3, the resiliently deformable spring plate 144 is substantially flat when no load is applied. The spring plate 144 is provided with an elongate aperture 152 corresponding to the shape of the lug 140 and centrally aligned for receiving the lug 140 therethrough. When mounted to the base of the scraper block 110, the lug 140 projects through the aperture 152 of the spring plate 144 for receipt in the corresponding recess 142 in the recessed waisted portion 122, thereby sandwiching the spring plate 144 between the central tubular body portion 108 and the scraper block 110 and deforming the spring plate 144 to correspond generally to the shape of the inner face 146 of the scraper block 110 when the casing scraper is assembled. The spring plate 144 is therefore compressed and biases the associated scraper block 110 radially outwardly.

The characteristics of the spring plate 144, for example, the force applied to the scraper plate 144, can be determined by appropriate selection of the features of the spring plate 144, such as material, length, width, hardness, etc.

When deformed in the assembled casing scraper 100, the spring plate 144 acts as a flexible spring, bearing against the central tubular portion 108 of the tool and against the inner face 146 of the scraper block 110, urging the latter outwardly to the extent limited by engagement of the shoulders 136, 138 with the projections 124, 126.

Although not shown, the spring plate 144 may be provided with a series of equiangularly spaced apertures which generally align with the fluid inlet apertures 148 of the scraper block 110 when the casing scraper is assembled, to prevent the spring plate 144 from obstructing the internal pathway for fluid to pass through the cleaning tool.

In this embodiment, the spring plate 144 is formed from a composite epoxy type resin based material or other drillable material including, but not limited to, cast iron or aluminium alloy. However, the type and grade of material composition of the spring plate 144 may be selected based on desired physical properties including, but not limited to, hardness, toughness, wear and resistance, tensile strength and spring constant. Factors affecting the selection of materials include the ability to retain a shape memory and ability to be drilled and or dissolved.

Magnesium based materials may be selected for their ability to dissolve when exposed to oxygen, water and salts. In order to reinforce the magnesium based materials against the rigors of down well operation, the tool may be constructed from magnesium based materials using techniques such as laser shock peening to make the materials harder and stronger and able to withstand corrosion during the initial run. Thereafter, the tool may be left down well to dissolve in a solution of oxygen, water and salts.

Both a drillable material and dissolvable material are required to be sufficiently strong to satisfy normal handling and service requirements and has the ability to form small chip like cuttings when drilled with a conventional rock bit or the like, so that the bit cuttings can be carried from the well by the return circulation of fluid thereby overcoming the problem associated with drilling of high tensile components such as compression springs, bolts, screws and caps. However, it is also envisioned that the tool and its components may be formed from more durable materials such as hardened steel and or toughened composite materials were a re-useable tool is required, suitable for several re-runs of the down well cleaning operation.

In addition, the biasing force applied to the each scraper block 110 may be provided by a plurality of compression springs positioned within the recessed waisted portion 122 and behind the inner face 146 of each associated scraper block 110, which biases the scraper blocks 110 radially outwardly towards the inner wall of the casing.

The present description is for illustrative purposes and should not be construed to narrow the breadth of the present disclosure in any way. Thus, those skilled in the art will appreciate that various modifications might be made to the presently disclosed embodiments without departing from the full and fair scope of the present disclosure. For example, the outer surface of each cleaning element could comprise a plurality of cleaning bristles. In another example the scraper blocks may be equiangularly and longitudinally displaced with respect to each other around the circumference of the tool. In addition, the diameter of the fluid channels 150 may vary along their length to increase/ decrease the resultant pressure within the fluid channels 150. Other aspects, features and advantages will be apparent upon examination of the attached drawings and appended claims.

The invention is not restricted by the details of the foregoing embodiment, for example a different number of scraper blocks 110 may be disposed on the outer surface of the tubular portion 108. In addition, the plurality of scraper blocks 110 may not be identical.

The invention claimed is:

1. A well cleaning tool comprising:

an elongate body having a longitudinal axis;

a central fluid bore aligned with the longitudinal axis;

a cleaning element mounted on the elongate body and being displaceable with respect to the elongate body in a direction inclined to the longitudinal axis, wherein the cleaning element comprises at least one fluid channel in fluid communication with the central fluid bore and extending through the cleaning element in a direction substantially perpendicular to the longitudinal axis; and a biasing means for biasing the cleaning element in a direction inclined to the longitudinal axis, wherein the biasing means comprises a resiliently deformable plate member mounted between the elongate body and the cleaning element and located in a recess in the elongate body, wherein the recess is configured to be in fluid communication with the central fluid bore, such that fluid pressure within the central fluid bore is applied to the recess.

2. The well cleaning tool of claim 1, wherein the resiliently deformable plate member abuts the cleaning element and the elongate body.

3. The well cleaning tool of claim 1, wherein the cleaning element comprises a concave inner face.

4. The well cleaning tool of claim 1, includes a plurality of cleaning elements.

5. The well cleaning tool of claim 1, wherein the cleaning element is displaceable laterally.

6. The well cleaning tool of claim 5, wherein the cleaning element is displaceable radially with respect to the longitudinal axis.

7. The well cleaning tool of claim 1, wherein the cleaning element is secured to the elongate body by a press-fit connection.

8. The well cleaning tool of claim 1, wherein the cleaning element comprises a casing scraper.

9. The well cleaning tool of claim 8, wherein the casing scraper comprises axially separated, helical grooves on its outer surface.

10. The well cleaning tool of claim 8, wherein the casing scraper comprises axially separated, helical teeth on its outer surface.

11. The well cleaning tool of claim 1, wherein the well cleaning tool comprises a plurality of cleaning elements.

12. The well cleaning tool of claim 11, wherein the plurality of cleaning elements are identical.

13. The well cleaning tool of claim 11, where the plurality of cleaning elements is equiangularly displaced with respect to each other.

14. The well cleaning tool of claim 1, wherein the well cleaning tool comprises a drillable material.

15. The well cleaning tool of claim 1, wherein the resiliently deformable plate member comprises a drillable material.

16. The well cleaning tool of claim 1, wherein the resiliently deformable plate member comprises an epoxy resin based material.

17. The well cleaning tool of claim 1, comprising connection means at one or both ends of the elongate body, for connection to a drill string.

18. The well cleaning tool of claim 17, wherein the elongate body is configured to be secured against rotation on and against longitudinal movement along the drill string.

19. The well cleaning tool of claim 1, wherein the fluid channel extends between an inlet aperture formed on an inner face of the cleaning element and an outlet aperture formed in a helical groove on the outer surface.

20. The well cleaning tool of claim 19, wherein the inlet aperture is configured to be in fluid communication with the recess, such that fluid pressure within the recess is applied to the fluid channel.

21. The well cleaning tool of claim 19, wherein the cleaning element comprises a plurality of fluid channels each having an inlet aperture and an outlet aperture.

22. The well cleaning tool of claim 21, wherein the outlet apertures are equiangularly spaced in helical grooves.

23. The well cleaning tool of claim 22, wherein the resiliently deformable plate member comprises a plurality of outlet apertures that align with the fluid inlet apertures formed on the inner face of the cleaning element when assembled.

24. The well cleaning tool of claim 1, wherein the tool cleaning elements comprise steel bristles.

25. The well cleaning tool of claim 1, wherein the cleaning tool comprises a dissolvable material.

26. The well cleaning tool of claim 25, wherein the dissolvable material is magnesium based.

27. The well cleaning tool of claim 1, wherein the resiliently deformable plate member is substantially flat prior to assembly.

28. The well cleaning tool of claim 27, wherein the resilient deformable plate member deforms to correspond generally to a shape of an inner face of the cleaning element when assembled.

* * * * *